US008528140B1

(12) United States Patent
Phillips et al.

(10) Patent No.: US 8,528,140 B1
(45) Date of Patent: Sep. 10, 2013

(54) ADJUSTABLE SCOPE MOUNT

(75) Inventors: Karl Phillips, Tacoma, WA (US); Richard Barnes, Gig Harbor, WA (US)

(73) Assignee: McCann Industries, LLC, Spanaway, WA (US)

( * ) Notice: Subject to any disclaimer, the term of this patent is extended or adjusted under 35 U.S.C. 154(b) by 32 days.

(21) Appl. No.: 13/233,429

(22) Filed: Sep. 15, 2011

Related U.S. Application Data

(60) Provisional application No. 61/503,636, filed on Jul. 1, 2011.

(51) Int. Cl.
*F41G 1/00* (2006.01)

(52) U.S. Cl.
USPC ..... 12/111; 42/125

(58) Field of Classification Search
USPC 42/90, 124, 125, 126, 127, 111; 248/223.41, 248/223.51, 223.61, 224.8, 225.11
See application file for complete search history.

(56) References Cited

U.S. PATENT DOCUMENTS

| | | | | |
|---|---|---|---|---|
| 1,770,451 | A | 7/1930 | Baker | |
| 1,926,151 | A | 9/1933 | Jung | |
| 2,004,489 | A | 6/1935 | Kuhn | |
| 2,018,960 | A | 10/1935 | Kuhn | |
| 2,073,210 | A | 3/1937 | Horsrud | |
| 2,101,037 | A | 12/1937 | O'Neil | |
| 2,135,774 | A | 11/1938 | Tilden | |
| 2,143,167 | A | 1/1939 | Pechar | |
| 2,208,913 | A | 7/1940 | Unertl | |
| 2,641,057 | A | 6/1953 | Moore | |
| 2,663,083 | A | 12/1953 | Harms | |
| 3,406,455 | A | 10/1968 | Akin, Jr. | |
| 3,471,932 | A | 10/1969 | Luning | |
| 4,317,304 | A | 3/1982 | Bass | |
| 4,397,107 | A | 8/1983 | Holden | |
| 5,086,566 | A | 2/1992 | Klumpp | |
| 5,144,752 | A | 9/1992 | Boeke et al. | |
| 5,274,941 | A | 1/1994 | Moore | |
| 5,400,539 | A | 3/1995 | Moore | |
| 5,428,915 | A | 7/1995 | King | |
| 5,787,630 | A * | 8/1998 | Martel | 42/125 |
| 6,295,754 | B1 | 10/2001 | Otteman et al. | |
| 6,662,486 | B2 | 12/2003 | Komberger | |
| 6,708,439 | B1 | 3/2004 | Laitala | |
| 7,140,143 | B1 | 11/2006 | Ivey | |
| 7,543,405 | B1 | 6/2009 | Ivey | |
| 2009/0307956 | A1 | 12/2009 | Barret | |

OTHER PUBLICATIONS

Scope Ring Mounts With Attached Picatinny Rails. <http://web.archive.org/web/20090323022135/http://www.moteng.com/DOH367-Scope-Ring-Mounts-2-Medium-35mm-w-Picatinny-Rails>. Mar. 23, 2009.*

* cited by examiner

*Primary Examiner* — Gabriel Klein
(74) *Attorney, Agent, or Firm* — Wood, Herron & Evans, LLP

(57) ABSTRACT

An adjustable mount for attaching a sighting device to a firearm includes an elongated base member and an elongated mount member longitudinally slidably engageable with the base member. Either the base member or the mount member includes a plurality of nonparallel longitudinal engagement slots. The other of the base member or the mount member includes a longitudinal engagement tongue which is selectively longitudinally slidably engageable in each of the plurality of slots to selectively position the mount member at different angles relative to the base member. At least one transverse clamping member is configured to secure the base member and mount member against relative longitudinal movement.

9 Claims, 6 Drawing Sheets

ADJUSTABLE SCOPE MOUNT

RELATED APPLICATION

This application claims the benefit of U.S. Provisional Patent Application No. 61/503,636, filed Jul. 1, 2011.

TECHNICAL FIELD

The present invention relates to a mount for attaching optics or other sighting devices to a firearm. More specifically, it relates to a mount that may be adjustably reconfigured to attach the sighting device at multiple preselected angles of declination.

BACKGROUND

Optical scopes are mounted on rifles to provide a clear magnified image of a target and to provide an adjustable aiming point to indicate the point of impact of a projectile on a target. Scopes typically have an internal optical adjustment to shift the image or apparent location of the crosshairs or other reticle to compensate for the amount that the bullet drops below the axis of the barrel as it travels over a distance. A similar lateral adjustment is normally provided for windage compensation.

On firearms having a relatively short maximum effective range (under about 600 meters), the scope may be mounted such that its sighting axis is approximately aligned with the bore axis of the barrel and is adjusted vertically in elevation and adjusted laterally in windage such that the point of aim observed by the shooter is the point of impact of the projectile at the desired range. Other elevation and windage adjustments may be necessary based on number of well known factors including wind speed and direction, temperature, humidity, projectile shape and mass, and powder mass and burn characteristics. Since projectiles follow a ballistic path, adjustments of elevation may be a critical factor for hitting targets at ranges approaching the maximum range of the cartridge-rifle combination. Because all projectiles are affected by the Earth's gravitational pull, the ballistic path always follows a downward arc, requiring the bore axis of the barrel to be elevated relative to the target (or for the line of sight to be declined in elevation relative to the bore axis of the barrel).

The range in elevation adjustments needed for telescopic scopes mounted to high powered sporting and military rifles capable of hitting targets at distances greater than about 600 meters frequently exceeds the range in elevation adjustments achievable by adjustment mechanisms incorporated within the telescopic scope itself. Scope-mounting systems are available that provide a selected angular deviation that points the scope slightly downward with respect to the barrel bore axis. The angular deviation is typically less than one degree, with a deviation in the range of 10-50 minutes of angle (MOA) being typical. The deviation may be manufactured into a rail system to which a scope mount is attached or in a scope mount having rings encompassing a scope tube, with the rear ring at a higher elevation than the front ring. This allows use of a practical internal scope adjustment mechanism that employs the upper range of adjustment for nearer shots and the lower range below a neutral setting for more distant shots where bullet drop is greatest.

While a mount having a single, preselected angle of declination is effective for use with a given cartridge or firearm to hit targets within a selected range of distances, a single angled mount is not suitable for a varied range of cartridges or versatile for a wider range of target distances. Thus, numerous different-angled mounts must be manufactured and stocked, and users must buy multiple mounts to provide for different applications or settle for a compromise that is sub-optimal at other extreme of the range. Changing the mount may be inconvenient for a sporting shooter who uses the same rifle to compete at 500 meters and 1,500 meters. But, for a sniper operating in a theater of war who may engage targets at as little as 350 meters and at well over 1,500 meters during the same mission, changing the mount is impractical, if not impossible.

In the past, field-adjustable mounts have been proposed. One type provides a pivot axis for moving the angle of a mounting rail. Another uses a pivot in one of the scope mounting rings with the other ring being adjustable in height. When sighting accuracy within ¼ MOA (or a 0.1 milliradian) is necessary and such mounts are subjected to the repeated recoil impact forces of a heavy caliber rifle, a pivotal mounting system may not provide sufficient stability and durability.

SUMMARY OF THE INVENTION

The present invention provides an adjustable mount for attaching a sighting device to a firearm. It includes an elongated base member and an elongated mount member that is longitudinally slidably engageable with the base member. Either the base member or the mount member includes a plurality of nonparallel longitudinal engagement slots. A longitudinal engagement tongue is provided on the other member. The tongue is selectively longitudinally slidably engageable in each of the plurality of slots to selectively position the mount member at different angles relative to the base member. At least one transverse clamping member is configured to secure the base member and mount member against relative longitudinal movement.

BRIEF DESCRIPTION OF THE DRAWING

Like reference numerals are used to indicate like parts throughout the various figures of the drawing, wherein.

DETAILED DESCRIPTION OF THE INVENTION

Figure 1:
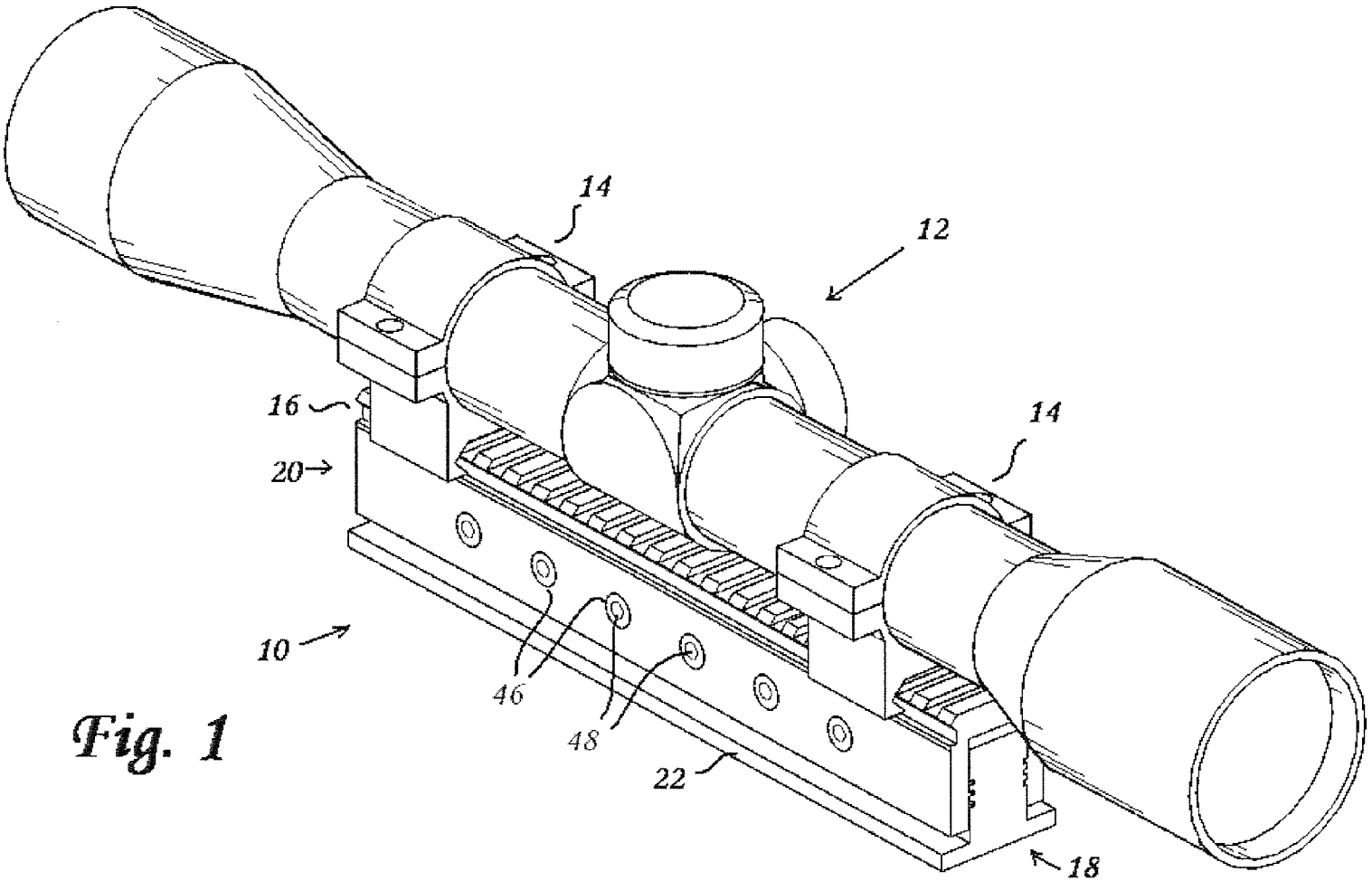
FIG. 1 is an isometric view of one embodiment of the invention showing a riflescope mounted thereon.

Referring to the various figures of the drawings and first to FIG. 1, therein is shown at 10 a scope mount according an embodiment of the present invention with an internally adjustable telescopic sight 12 mounted thereon. The illustrated scope 12 is mounted using a pair of scope rings 14 which clamp to a standardized Picatinny mounting rail 16 presented at the top of the mount 10.

Figure 2:
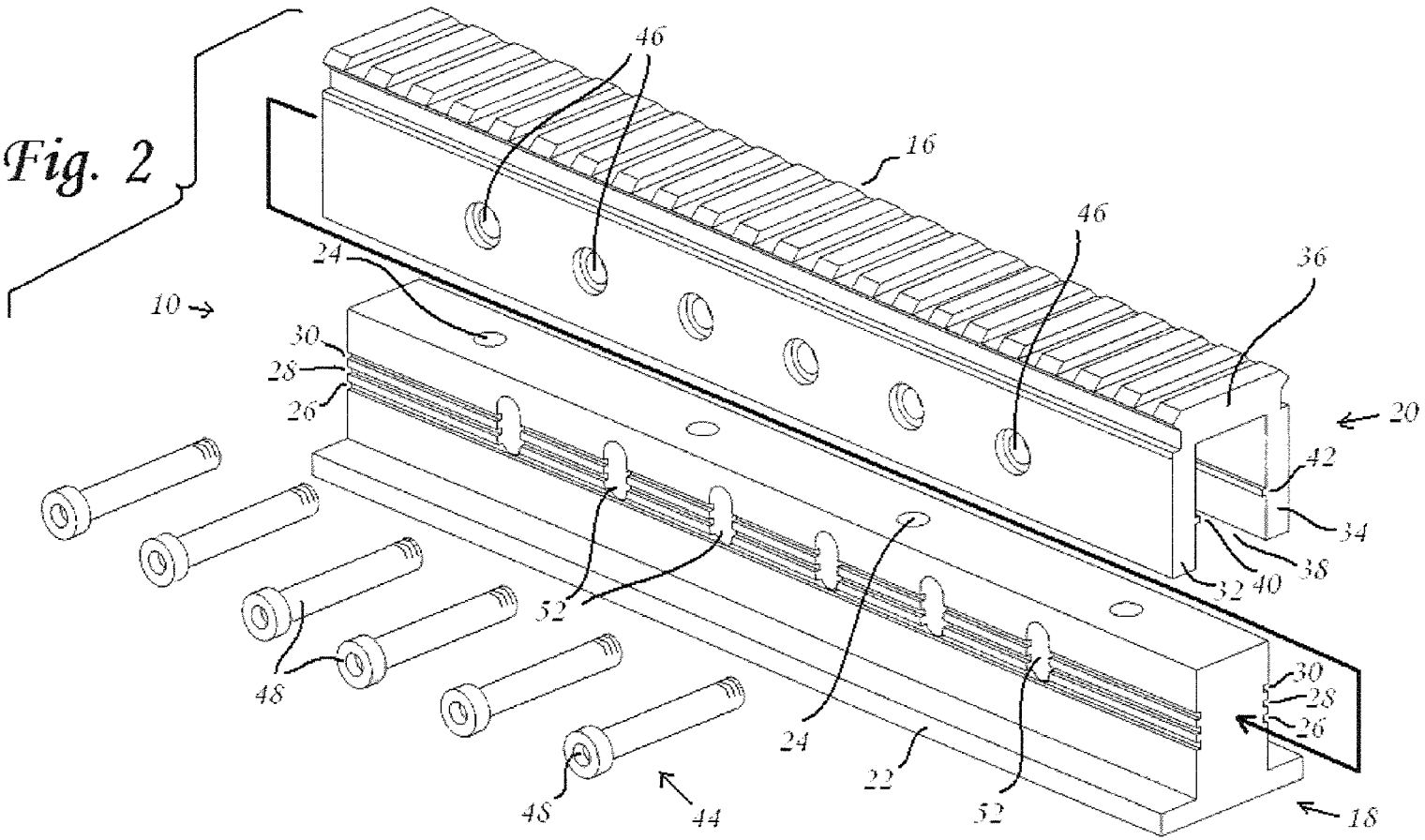
FIG. 2 is an exploded isometric view of the adjustable mount.

Referring now also to FIG. 2, therein is shown the various components of this embodiment of the scope mount 10. It includes a base member 18 and a mounting member 20. The base member 18 includes a bottom portion 22 which is configured for secure attachment to a firearm receiver, barrel, or stock. Alternatively, the base member 18 may be manufactured integral with a firearm receiver, barrel, or stock (not shown). The base member 18 may include attachment openings 24 which are adapted to receive fasteners (not shown) for securely attaching the base member 18. The scope mount 10 may be integrated into a more extensive accessory mounting system, portions of which may not need to be adjustable in angle. For example, a secondary mounting rail may extend forward of the mounting member 20 to hold a night vision device in a generally aligned position with the day scope 12. Side accessory rails (not shown) may be integrated for attachment of target indicators or illuminators. Mounts for these other devices may not require the angle adjustment feature of the present invention.

Figure 2A:
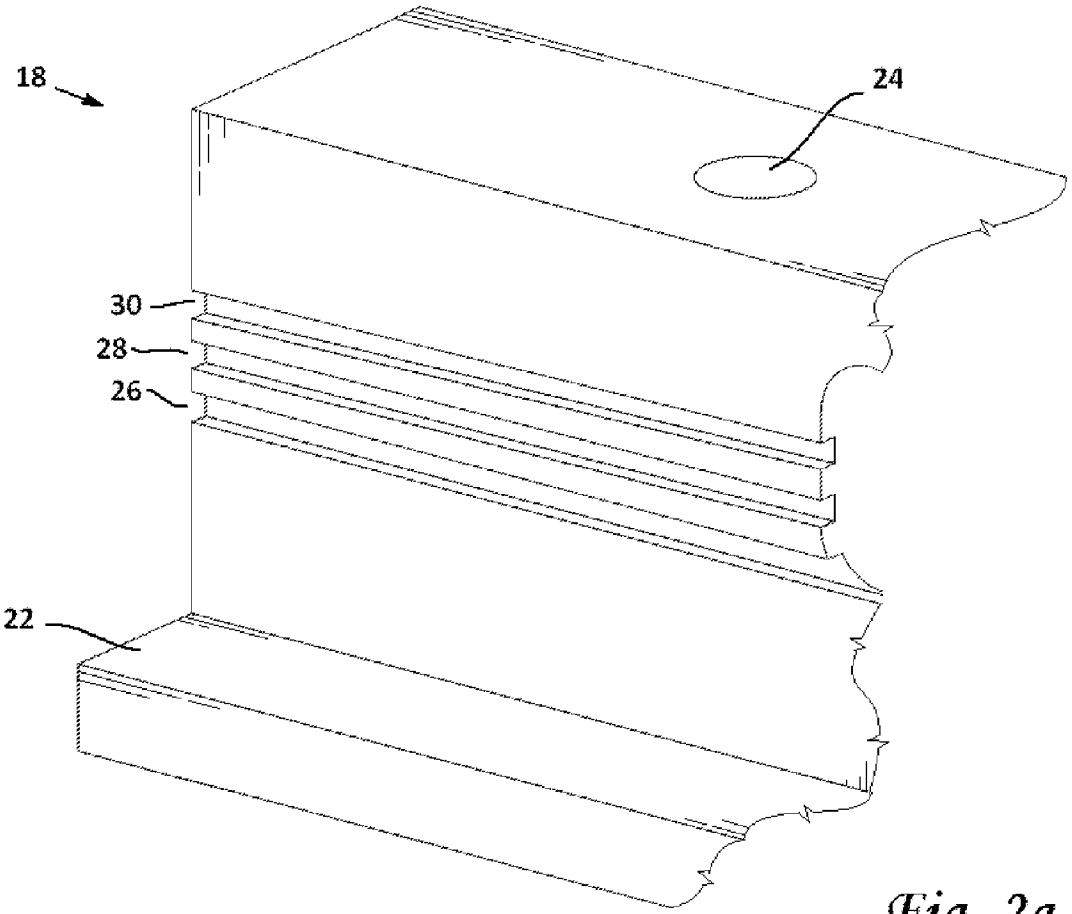
FIG. 2*a* is a fragmentary enlarged isometric view of a forward portion of the base member showing the nonparallel configuration of the elongated slots.

Along opposite lateral sides of the base member 18 may be a plurality of nonparallel longitudinal engagement slots 26, 28, 30. The engagement slots 26, 28, 30 are not parallel to each other, although one of them may be configured to be substantially parallel to the bore axis of a firearm barrel (not shown) to which the mount 10 is attached or integrated. The plurality of engagement slots 26, 28, 30 are precisely machined longitudinally at slight, preselected angles relative to one another. For example, the variance between two of the engagement slots 26, 28, 30 may be 10, 15, or 20 minutes of angle (MOA). Because the nonparallel configuration of the engagement slots 26, 28, 30, being as little as 5 MOA (1/12 of one degree), may not be visually perceptible, the configuration is exaggerated for illustration in FIG. 2*a*.

The mounting member 20 may include a pair of flange portions 32, 34 which extend downwardly from a top portion 36 to form a downwardly-oriented longitudinal channel 38. The top portion 36 is configured to receive a scope 12 mounted thereon, such as by way of integral scope rings (not shown) or a standardized Picattiny rail 16 to which scope rings 14 or other mounting devices may be secured.

Figure 3:
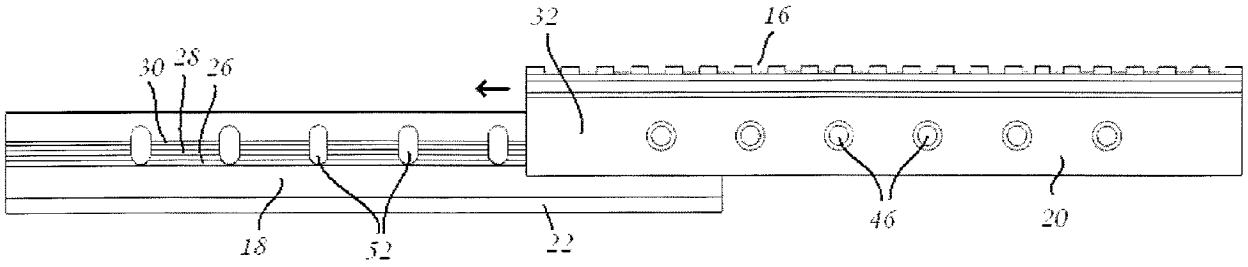
FIG. 3 is a side plan view showing a mount member partially slidably engaged on a base member.
Figure 7:
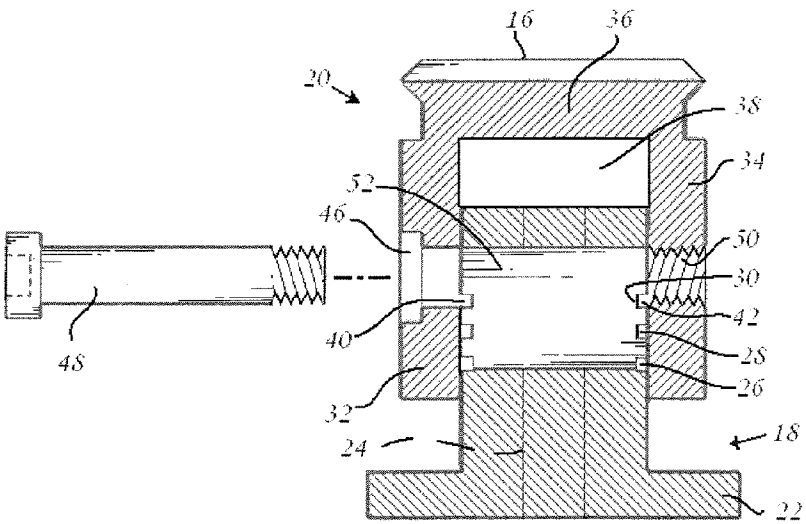
FIG. 7 is a transverse sectional view taken substantially along line 7-7 of FIG. 4.
Figure 4:
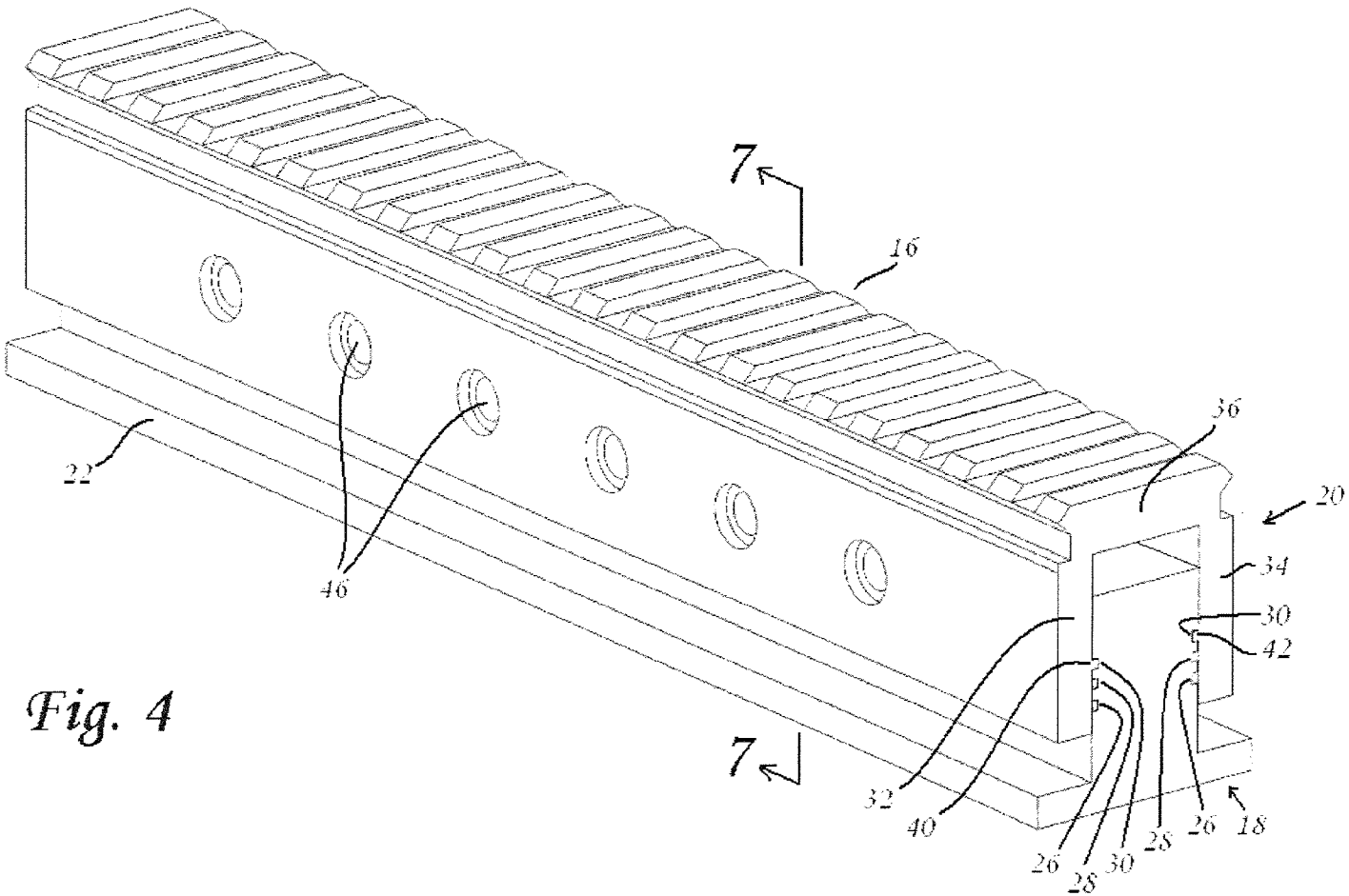
FIG. 4 is an isometric view of the mount member and base member assembled in a selected position.

Lateral inboard surfaces of the flange portions 32, 34 may include longitudinal tongue portions 40, 42. The channel 38 is sized to closely engage sides of the base member 18 when the mounting member 20 is longitudinally slidably assembled thereon with each of the tongue portions 40, 42 respectively engaging an opposite pair of the plurality of longitudinal engagement slots 26, 28, 30. FIG. 3 shows base member 18 and mounting member 20 in a partially assembled position as the mounting member 20 is being slid into place on the base member 18. FIG. 4 shows the mounting member 20 assembled in position on the base member 18 with the tongue portions 40, 42 longitudinally engaged in the uppermost pair of longitudinal engagement slots 30.

Figure 6:
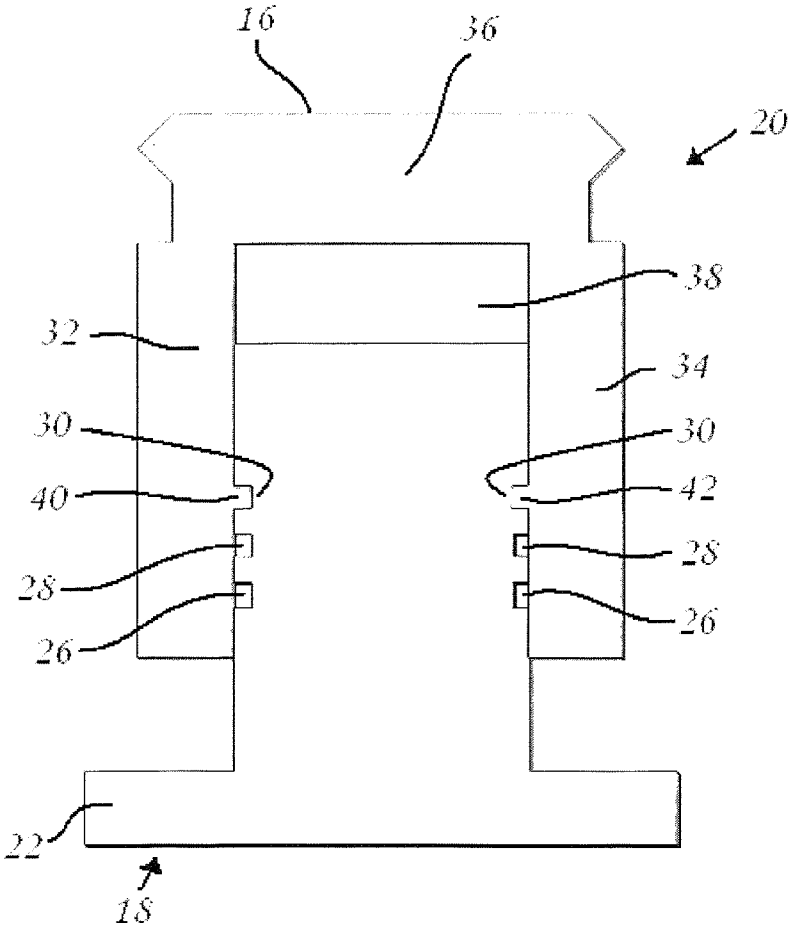
FIG. 6 is an end plan view of the adjustable scope mount assembled in a second position.
Figure 5:
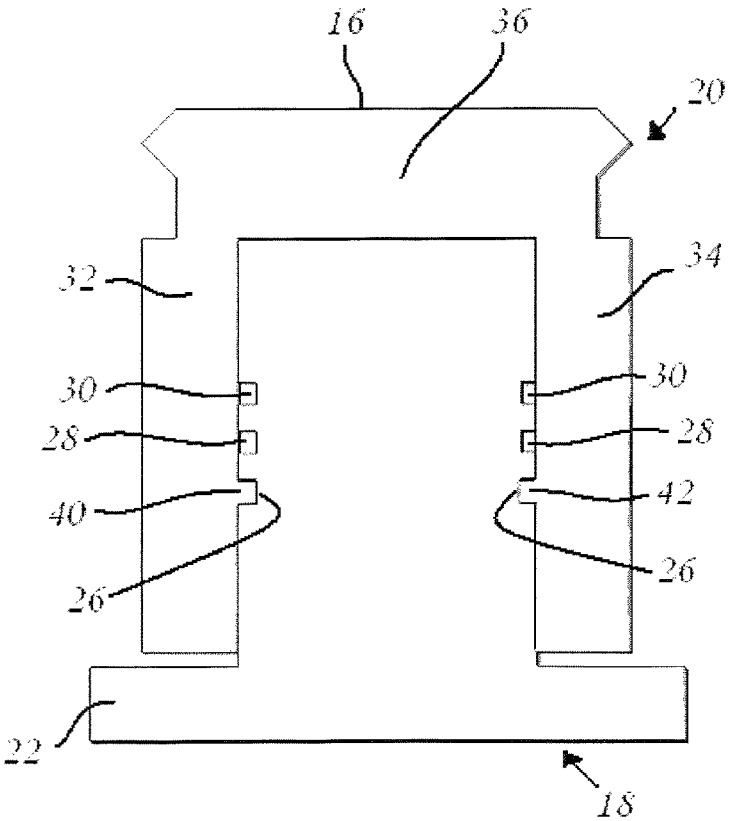
FIG. 5 is an end plan view of the adjustable scope mount assembled in a first position.

Referring now in particular, to FIGS. 5 and 6, it can be seen that the mounting member 20 can be longitudinally engaged on the base member 18 with the tongue portions 40, 42 in each of the opposed pairs of engagement slots 26, 28, 30. FIG. 5 shows the tongue portions 40, 42 engaged in the lowermost pair of engagement slots 26. FIG. 6 shows the tongue portions 40, 42 engaged in the uppermost pair of engagement slots 30. Although not specifically illustrated, it is understood that the tongue portions 40, 42 may also be positioned to slidably engage the middle pair of engagement slots 28. Thus, by sliding the mounting member 20 onto the base member 18 with the tongue portions 40, 42 in a selected pair of engagement slots 26, 28, 30, the mounting member 20 may be positioned at preselected angles relative to the base member 18 and the bore axis of a firearm barrel (not shown). Because the tongue portions 40, 42 and engagement slots 26, 28, 30 may be of relatively small vertical dimensions, the difference in vertical height of the mounting member 20 is a relatively small variation.

Referring now in particular to FIGS. 1-4 and 7, the mount 10 may include one or more transverse clamping member 44 to securely hold the mounting member 20 in place against longitudinal displacement on the base member 18. For example, the mounting member 20 may include one or more opening 46 sized to receive a fastener, such as a bolt 48. The bolt 48 may be sized to span the entire width of the mounting member 20 from one flange 32 to the other 34. A transversely aligned complementary opening 50 (see FIG. 7) may be provided in the opposite flange portion 34, which may be threaded to engage the bolt 48 or a separate nut (not shown) can be used. A corresponding opening 52 may be provided transversely in the base member 18. In preferred form, the corresponding opening 52 is sized to closely fit the bolt 48 along the longitudinal direction of the mount 10 but to be enlarged in vertical dimension so as to receive the bolt 48 no matter which of the engagement slots 26, 28, 30 is being used to receive the tongue portions 40, 42. This is most clearly shown in FIGS. 2 and 7. In preferred form, a plurality of transverse clamping members 44 are used at longitudinally spaced intervals along the base member 18 and mounting member 20.

In this manner, a substantial surface area of the base member 18 and mounting member 20 are firmly clamped together to provide a friction fit that resists longitudinal displacement. Moreover, longitudinal shear loads are carried by one or more bolts 48 engaged in corresponding openings 52 of the base member 18 and openings 46, 50 in the mounting member 20. Vertical loads are carried by engagement of the tongue portions 40, 42 in the longitudinal engagement slots 26, 28, 30. Despite the relatively small vertical and transverse dimensions of the tongue portions 40, 42 and engagement slots 26, 28, 30, the substantial amount of overall area and clamping force provided transverse clamping members 44 make the mount 10 very strong while allowing for precise increments of declination to be selected.

Alternatively, the tongue portions 40, 42 may be formed on the mounting member 20 at a small angle, such as 5 MOA, relative to horizontal. In this manner, if the mounting member 20 is engaged on the Base member 18 is one orientation, the effective angle provided by each of the engagement slots 26, 28, 30 is reduced by this amount. If the orientation of the mounting member 20 is reversed, the effective angle provided is increased by 5 MOA. In this manner, angles in between those provided by the engagement slots 26, 28, 30 may be provided, effectively multiplying the number of preselected angles of adjustment available.

If desired, one end of each of the engagement slots 26, 28, 30 may be slightly narrowed and/or an opposite end of each tongue portion 40, 42 may be slightly widened in order to maximize the frictional fit between the base member 18 and mounting member 20 when fully longitudinally engaged together while allowing relatively easy sliding movement during the majority of longitudinal travel as the parts 18, 20 are assembled or disassembled. Alternatively, a mechanical stop (not shown) could be integrated into the base member 18 and/or mounting member 20 in order to further resist longitudinal displacement between the members, at least in one direction, when assembled.

Although it is not expected that adjustment of the mount 10 would be used to make rapid adjustments to the elevational position of a scope 12 or other sighting device, repositioning would not require the services a skilled armorer, but could be accomplished even in the field using no more than a simple tool for removing or tightening the transverse clamping members 44. Precise and repeatable alignment is achieved after disassembly and reassembly of the mounting member 20 on the base member 18. The base member 18 remains rigidly fixed and aligned with the bore axis of the barrel and is not disturbed by repositioning of the mounting member 20.

As used herein, "forward" or "front" refers to the muzzle or discharge end or direction of a firearm, distal from the user. "Rearward" or "rear" refers to end of the firearm proximal to the user and opposite the direction of a projectile discharge.

The illustrated embodiment was chosen and described to provide the best disclosure of the principles of the invention and its practical application to thereby enable one of ordinary skill in the art to utilize the invention in various embodiments and with various modifications as are suited to the particular use contemplated. All such modifications and variations are within the scope of the invention as determined by any allowed claims when interpreted in accordance with the breadth to which they are fairly, legally and equitably entitled. The drawings and preferred embodiments do not and are not intended to limit the ordinary meaning of the claims and their fair and broad interpretation in any way.

What is claimed is:

1. An adjustable mount for attaching a sighting device to a firearm, comprising:

an elongated base member;

an elongated mount member longitudinally slidably engageable onto the base member;

a plurality of nonparallel longitudinal engagement slots on one of the base member and the mount member;

a longitudinal engagement tongue on the other of the base member and the mount member, the tongue being selectively longitudinally slidably engageable in each of the plurality of slots to selectively position the mount member at different angles relative to the base member;

at least one transverse clamping member configured to secure the base member and mount member against relative longitudinal movement; and wherein the mount member includes a Picatinny rail.

2. The adjustable mount of claim 1, comprising at least three longitudinal engagement slots.

3. The adjustable mount of claim 2, wherein adjacent longitudinal engagement slots are configured with a difference of at least 10 MOA.

4. The adjustable mount of claim 1, wherein the base has an upwardly extending body with the engagement slots in at least one lateral side thereof and the mounting member has a pair of longitudinally extending flanges forming a channel there between with an engagement tongue on a laterally inward side of at least one of the flanges.

5. The adjustable mount of claim 1, wherein at least one of the engagement tongue or the engagement slots are configured to prevent further longitudinal travel beyond a fully assembled position.

6. The adjustable mount of claim 1, wherein the base member is formed integral with a firearm.

7. The adjustable mount of claim 1, wherein the base member is removably attachable to a firearm.

8. The adjustable mount of claim 1, wherein the transverse clamping member includes a threaded bolt, the base member and mounting member having transverse openings formed therein for receiving the bolt.

9. The adjustable mount of claim 8, wherein the transverse opening of either the base member and mounting member is vertically enlarged such that the bolt can be received therein while the mount is assembled at each of the selected angle positions.

* * * * *